US005258596A

United States Patent [19]

Fabish et al.

[11] Patent Number: 5,258,596

[45] Date of Patent: Nov. 2, 1993

[54] MICROWAVE ABSORBER DESIGNS FOR METAL FOILS AND CONTAINERS

[75] Inventors: Thomas J. Fabish, Export; Arthur Benson, Pittsburgh; Thomas L. Levendusky, Greensburg; Barbara O. Hall, Monroeville; James E. Stillwagon, New Kensington; J. Glenn Davidson, Freeport, all of Pa.

[73] Assignee: Aluminum Company of America, Pittsburgh, Pa.

[21] Appl. No.: 670,008

[22] Filed: Mar. 15, 1991

[51] Int. Cl.[5] ..... H05B 6/68

[52] U.S. Cl. ..... 219/10.55 F; 219/10.55 E; 219/10.55 M; 219/10.55 R; 426/107; 426/113; 426/234; 426/243; 428/328; 99/DIG. 14; 342/1

[58] Field of Search ..... 219/10.55 E, 10.55 M, 219/10.55 F, 10.55 R; 428/328; 426/107, 113, 234, 243; 99/DIG. 14

[56] References Cited

U.S. PATENT DOCUMENTS

| | | | |
|---|---|---|---|
| 4,012,738 | 3/1977 | Wright | 343/18 A |
| 4,230,924 | 10/1980 | Brastad et al. | 219/10.55 E |
| 4,266,108 | 5/1981 | Anderson et al. | 219/10.55 E |
| 4,641,005 | 2/1987 | Seiferth | 219/10.55 E |
| 4,904,836 | 2/1990 | Turpin et al. | 210/10.55 E |
| 4,962,000 | 10/1990 | Emslander et al. | 219/10.55 E |
| 5,019,681 | 5/1991 | Lorence et al. | 219/10.55 E |
| 5,021,293 | 6/1991 | Huang et al. | 428/328 |
| 5,038,009 | 8/1991 | Babbitt | 219/10.55 E |

*Primary Examiner*—Bruce A. Reynolds
*Assistant Examiner*—Tu Hoang
*Attorney, Agent, or Firm*—Elroy Strickland

[57] ABSTRACT

Means and method for heating loads with microwave energy, with the loads being located on a metal substrate or in a metal container. A layer of organic material is located on the outside surface of the container or substrate, the layer having microwave absorbing substances contained in a minimum thickness of the layer. The absorbing substances include both dielectric and magnetic components that provide useful power absorption, the amount of the dielectric component being effective to compress the wavelength of the microwave energy while simultaneously preserving useful impedance to the magnetic component of the energy. Useful power absorption within a range of minimum layer of thicknesses is obtained. The amounts of the dielectric and magnetic components, in addition, transport the heat generated within the layer to the metal container or substrate at rates sufficient to maintain internal temperature of the layer near that of the load. A thin impedance matching film is located on the surface of the layer opposite that of the metal substrate.

13 Claims, 1 Drawing Sheet

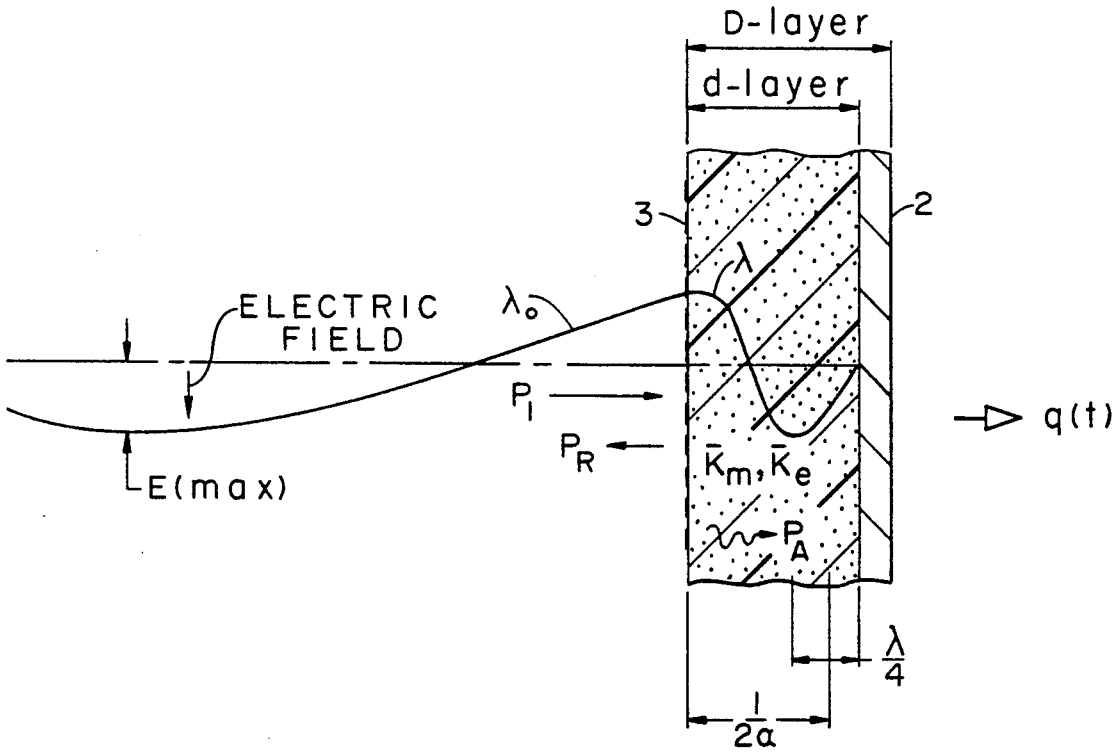
D-layer
d-layer
3
2
λ
λo
ELECTRIC
FIELD
P1
PR
q(t)
E(max)
Km, Ke
PA
λ/4
1/2α

MICROWAVE ABSORBER DESIGNS FOR METAL FOILS AND CONTAINERS

BACKGROUND OF THE INVENTION

The present invention relates generally to overlays of organic polymer films, the volumes of which are provided with "lossy" components for dispersal on metal foil to render the foil "active" for microwave heating and cooking. The invention relates, in addition, to a methodology for predicting the heating behavior of the combination of film and foil, and a thin impedance matching film.

Metal foil and metal containers have certain attractive features in regard to the heating of certain "loads", particularly the heating and cooking of food loads, which are dielectric in nature. For example, an aluminum foil or container has excellent "barrier" properties, which is generally not the case with microwave transparent and semi-transparent packages and containers, made from paper, plastics and metalized paper materials. Paper and plastics are generally penetrateable by ambient light and are somewhat porous to the atmosphere outside the container. Metal containers, of course, form a complete barrier to light and the atmosphere external to the container.

In the case of semi-transparent films, which currently use low bulk or surface loadings of active dielectric materials (including metals, semi-metals, organic or inorganic semi-conductors, and electrically insulating organic or inorganic compounds) for heating, the polymer matrix of the film, which is a poor heat conductor, dominates thermal transport properties. Low thermal transport causes the average film temperature to run high, even to self destruction, unless the film is everywhere well heat-sinked, or the structure of the absorbing particles or surface islands coincidently alters upon reaching a safe maximum design temperature to reduce energy absorption in the structure of the film.

Semi-transparent films loaded throughout their bulk with such dielectric particles, or surface loaded with such particles, as in the James River U.S. Pat. Nos. 4,626,641 and 4,590,349 to Brown, Canadian 1,53,069 and DuPont's U.S. Pat. No. 4,518,651 to Wolfe, distribute the power incident on the film between power reflected from the film, power transmitted through the film and power absorbed by the film in accordance with the intrinsic dielectric response of the materials and the film thickness. The physics governing energy partition amongst reflection, transmission and absorption (Maxwell's Equations) and the dielectric properties of available materials invariably forces a compromise between power absorption and film thickness in a given application. The particles in these cases are thin surface islands of metals or semi-metals, or these elements appear in some chemical arrangement with another element, such as oxygen or nitrogen.

For example, calculations show that polymer films loaded with an appropriate carbon in the range of 6 to 9% of wt/wt carbon/polymer may be made to absorb as much as 28% of the incident microwave power in a free standing mode, i.e., with no electrically conductive backing, with air being the medium on both sides of the film. (The effect of water or a food load on one side of a film is discussed below.) However, such values necessarily correspond to film thicknesses greater than 20 mils. Such high loadings are detrimental to both the mechanical properties of the films and their economics for packaging applications, and at such thicknesses, the inherent thermal transport properties of the films become a limiting factor to the viability of the films for cooking purposes.

For these technical reasons and for economic reasons, semi-transparent films are typically applied at five to ten mil thicknesses, with power absorption being on the order of three to eight percent (again, with ambient air existing on both sides of the film). The lower heat generation rates and inferior thermal transport rates combine to limit use of semi-transparent films to browning/crisping applications in food preparations, where the combination of elevated temperature and low heat transport are adequate to the task.

As a practical matter, transparent and semi-transparent laminated materials, as well as laminates using solid barrier metals, all are implemented under 37 boundary conditions" that affect the generation of thermal energy and its transport through the absorber structure to the load. For example, the electrical boundary conditions (or equivalently, the optical boundary conditions) imposed on the microwave absorbing film determine the governing equations describing the apportionment of incident microwave energy between reflection, absorption and transmission in the film; such quantities generally are referred to herein as the "optical response" of the absorbing structure. Calculating optical responses of the "D-layer" of the subject invention is discussed hereinafter on pages 18 and 19 of the present text. Similarly, the structures and temperatures of the film and the environment surrounding the film define thermal boundary conditions important to describing the transport of heat from the film where it is generated to the product or load.

The cited analysis provides a perspective on the heating performance of semi-transparent films, using air as a medium on both sides of the film. The analysis enables one to quote maximum anticipated film performance characteristics. The analysis further shows that the optical constants of a load adjacent to one side of a semi-transparent film will strongly influence microwave absorption in the film, since the film plus load will determine relative power absorption in the film versus power reflection at the surface of the film and power transmission through the film into the load.

For example, if water replaces air on the load side of a 5% carbon film five mils thick of the kind previously considered, the calculated power absorption in the film drops from 3% to less than 1%. This effectively eliminates the utility of the absorbing film. Each food load introduces its own constraint of this type for semi-transparent films. The influence of a load on the division of incident power between reflection, absorption, and transmission can be mitigated by the use of microwave transparent spacers, e.g., paperboard located between the semi-transparent film and load, as is done in a number of package designs, but only at the expense of aggravating the thermal transport/film temperature problem. In contrast thereto, there is no such consideration in a microwaveable metal foil strategy because the foil represents an electrical short circuit (or equivalently, a perfect reflector of a microwave) in its contribution to the net impedance of the absorber, thus eliminating any influence on the absorber performance from the optical characteristics of the load.

It is important to note that semi-transparent films having the bulk of the polymer or its surface loaded with dielectric particles or molecules will produce only second order effects on heating rates when these films are applied to an electrically conductive substrate like aluminum foil. ("Second order effects" in the present context means that the heat generation rate of the film is minor in magnitude and will not vary with differing film thicknesses over the sensible thickness range [0.5 to 20 mils] applicable in the packaging industry). This limitation is not encountered in the case of magnetic loadings. The limitation on dielectric films derives from the basic physics governing the interaction of an electromagnetic wave with dielectric material structures backed by a conductive substrate, and has been amply verified by experiments. The second order contribution that is observed with semi-transparent, dielectric films on aluminum foil most likely originates with the minor component of plane-polarized radiation, such polarization being defined by the electric component of a propagating electromagnetic wave that lies parallel to the plane of incidence to the foil surface in a multi-mode consumer oven. A possibly minor additional heating contribution may come from microwave scattering at the lossy particles which acts to enhance the optical path length within the absorbing layer while also altering the average polarization of the electromagnetic wave propagating through the lossy layer of the film/metal laminate.

Metal foil and metal containers have superior thermal conductivity, resulting in faster heatup times, than electromagnetic transparent materials, and can simultaneously minimize cooking hotspots that tend to occur with transparent and semi-transparent materials. If the metal is heated by a microwave absorbable layer located on the outside surface of the metal, the metal of the container is heated in a manner that emulates conventional thermal cooking. This provides good taste, odor, color and consistency of the food load cooked in such a container, and is expected to reduce or eliminate entirely the need to reconstitute foods specifically for microwave cooking or preparation.

SUMMARY OF THE INVENTION

The present invention is directed to layered microwave absorbing structures that effectively utilize reflection coefficients, absorption coefficients and transmission coefficients of commercially available "lossy" (i.e. power absorbing) materials. These parameters describe performance attainable with the structure in a consumer microwave oven and are calculable from the film thickness and independently measured "optical constants" of effective medium electric permitivity and magnetic permeability that depend upon the intrinsic structure and geometry of the lossy material.

A convenient choice of material parameters employed in the present invention use real and imaginary numbers as follows:

$\overline{K}_m = K_{mr} + iK_{mi}$ is the (complex) relative magnetic permeability of the lossy material at the electromagnetic wave frequency of interest; while $\overline{K}_e = K_{er} + iK_{ei}$ is the (complex) relative electric permittivity of the materials at the electromagnetic wave frequency of interest;

Other structure parameters that are utilized in the present invention are:

$\overline{R}$ = the (complex) amplitude reflection coefficient determined by $\overline{K}_e$, $\overline{K}_m$, u, d, and the electrical boundary conditions existing on the lossy, absorber structure, where $|\overline{R}|$ = the absolute value of $\overline{R}$, and $\nu$ = frequency of the microwave (approximately 2.45 GHz in the case of consumer microwave ovens).

($|\overline{R}| = 1$ for a perfectly reflecting surface, which is rather closely approximated but not equaled by highly conductive metals such as aluminum).

d = the thickness of a lossy layer d (in the figure of the drawing) located on an aluminum foil substrate 2 (Lossy layer d together with the foil substrate 2 comprise a D-layer absorber structure that is shown schematically in the figure and is discussed in detail hereinafter.)

The fundamental (complex) quantities $\overline{K}_e$ and $\overline{K}_m$ are effective medium values that describe the composite material comprising the lossy layer. Importantly, $\overline{K}_e$ and $\overline{K}_m$ are independently measurable using standard experimental microwave techniques and self-supporting lossy layer film samples. The invention thus utilizes a model that is truly predictive in determining the behavior of a microwave absorber, i.e., the performance calculations needed for a container design are derived from independent measurements performed on sample lossy films of arbitrary thickness.

In practice $\overline{K}_e$ and $\overline{K}_m$ are nearly totally determined by the nature and concentration of particulate and molecular materials contained in an appropriate polymer matrix. The composite film is particularly adaptable for dispersal on one surface of a metal foil. $\overline{K}_e$ and $\overline{K}_m$ govern the optical properties of the laminar combination which includes prescription of a heat generating capacity that is the salient quantity of interest in packaging applications.

Particulate and molecular loadings necessary to produce a desired optical performance also significantly impact thermal transport and mechanical properties of the lossy absorber. Hence, loadings must be specified in cognizance of thermal stability and mechanical requirements indigenous to the manufacturing processes involving the absorber and container, as well as the optical and thermal transport properties necessary to satisfy a heating and/or cooking application.

It is therefore an objective of the invention to utilize thermal boundary conditions in a foil coated with a microwave absorber to control the relative levels at which the absorber, foil and load will heat.

A primary objective of the invention provides an enhancement in power absorption of at least 12% of the power density incident on a metal container provided with a microwave absorbing layer of thickness reasonable for packaging applications over that obtained with bare metal foil. An increase in power absorption of this approximate magnitude at least doubles the heating rates associated with bare aluminum foil containing the same load, and having the same size, shape and position within the oven cavity. It should be noted that a 12% enhancement in power absorption is significant when one considers that the total power consumed in consumer microwave ovens can run as high as 1400 watts, 700 of which may appear within the oven cavity.

Additionally, the "D-layer" structure of the present invention, by virtue of its lossy interaction with the incident, transverse electromagnetic wave (TEM) of microwave frequency, reduces the strength of local electric and magnetic fields in the vicinity of the metal substrate. This provides effective smoothing of sharp container edges and impedes air breakdown and subsequent arcing within the oven cavity, relative to the breakdown probability associated with a practical bare metal container.

The above advantages and objectives, including additional advantages and objectives that will be explained below, are effected by the use of a continuous layer of organic material containing microwave absorbing substances, all of which is located on at least a portion of a metal substrate or container. The layer has a minimum thickness within a predictable range of minimum thicknesses, and the absorbing substances include both dielectric and magnetic components that within the minimum range of thicknesses provide useful power absorption when microwave energy interacts with the organic layer/metal laminate structure. The amount of the dielectric component is effective to compress the wavelength of microwave radiation while simultaneously preserving useful impedance set mainly by the magnetic component of the lossy layer, such that useful power absorption within the range of minimum thicknesses is obtained.

A further objective of the invention is to improve the match of the impedance of the lossy layer/metal foil laminate to that of the ambient air adjacent the lossy layer by use of a thin conductive film located on the lossy layer. By incorporating lossy dielectric elements in the conductive film layer, electric field interactions are enhanced in the thin surface film to aid heat generation The amounts of the dielectric and magnetic components, in addition, are sufficient to transport the heat provided by conversion of the microwave energy through the layer to the metal substrate at rates sufficient to maintain internal temperature of the layer near that of the load being heated. Close coupling of the absorber and load temperature constitutes an important heat control feature, while simultaneously enabling the use of lower performance, more cost effective organic materials, the matrix binding the active components into a continuous layer on the metal substrate or container.

All of these functions are made compatible in the present invention with existing, economical production techniques for the lossy layer/metal foil laminate, which includes the forming of the laminate into a rigid container. Furthermore, the materials comprising a microwaveable foil container made in accordance with this invention are amenable to recycling in large part thus promoting a favorable environmental impact for the product which in wide use may number in the millions of items disposed per year.

THE DRAWING

The objectives and advantages of the invention will be better understood by consideration of the following detailed description and the accompanying drawing, the sole figure of which is a schematic view of "d and D-layers" of the invention, and a thin surface film 3 of specified relative electrical resistance.

PREFERRED EMBODIMENTS

Referring now to the figure of the drawing, the electric field of microwave energy having wavelength $\lambda_o$ is shown incident to a D-layer, which layer is comprised of a polymer layer d containing lossy components and a metal foil 2. An impedance matching film 3 is shown located on the surface of the D-layer opposite that of the foil, and is discussed in detail hereinafter. The power density of the incoming wave is designated by $P_I$ while power reflection from the D-layer is designated by $P_R$. The optical properties of the metal and its thickness are typical of that employed in packaging applications. i.e., such properties insure that no fraction of the incident power is transmitted through the laminate D-layer structure. Hence, power absorption $P_A$ is given by the difference between $P_I$ and $P_R$.

The bold arrow pointing to q(t) in the figure represents the flow of heat through the metal foil to a load (not shown), the heat being generated by the interaction of the microwave energy (having wavelength $\lambda$ within the lossy layer) with active materials contained in the polymer of the D-layer. To a more minor extent, the microwave energy interacts with metal substrate 2, the metal being an imperfect electrical conductor and therefore an imperfect reflector described by $|\bar{R}|<1$.

A magnetic response to the incoming wave is imparted by iron or ferrite particles located in lossy layer d, and governs power absorption in the composite D-layer of the figure at lossy layer thicknesses appropriate for food packaging applications. Specifically, it can be theoretically and experimentally shown that the imaginary part, $K_{mi}$, of the magnetic response function governs power absorption, $P_A$, at small layer thicknesses. Commercially available magnetic particles, such as the nearly pure iron particulate produced by GAF Chemicals Corporation, enable effective D-layer designs only for polymer thicknesses greater than about 3 mils, with 5 to 15 mils being a reasonable, practical range.

As one example of demonstrated performance, an intrinsic volumetric heat generation of 3.1 cal/sec cm$^3$ (hereinafter referred to as "$\dot{g}$", is reached at 5:1 iron/-polymer (wt/wt/) loadings. Values of this magnitude are superior to those offered by all existing absorber designs in current use for food packaging.

Value $\dot{G}$ is the area normalized heat generation rate of the D-layer exposed to incident radiation PI. Similarly, $\dot{g}$ is the volumetric heat generation rate of the lossy layer d, defined by $\dot{g}=\dot{G}/P_I d$ where the lower case, d, in this instance is the thickness of the lossy layer, $\dot{g}$ values for absorbers suitable for cooking applications generally fall in the range of 0.7 to 4 cm$^{-1}$ with the upper range obtainable only through the concepts described herein. Any value of $\dot{g}$ within a caloric rate range, which is defined by the intrinsic magnetic properties of the particulate at the frequency of operation, can be obtained by varying the magnetic particle loading.

$\dot{G}$ is extrinsic quantity needed for the design purposes of the invention, i.e., for the microwaveable foil concept of the invention $\dot{G}$ is dependent upon appropriate magnetic particle loading through $\dot{g}$ and the lossy layer thickness. Practical D-layer absorbers will have lossy layer thicknesses ranging from 5 to 15 mils in the present invention. For, a perspective, a value of $\dot{G}$ commensurate with $\dot{g}$-3.1 cm$^{-1}$ (attained with a 5:1 iron/polymer loading) and a lossy layer thickness of 15 mils is 0.12 cal/sec cm$^2$ At an incident power density of 1.1 cal/cm$^2$ sec (4.6 watt/cm$^2$) typical of a 700 watt consumer oven, this value of $\dot{G}$ corresponds to a lowering of the absolute value of the amplitude reflection coefficient $\delta|\bar{R}|=0.06$ below that of bare metal for a 12% enhancement in power absorption over that achieved with bare metal. It is noted that significant contributions to the heating of food products were observed when $|\bar{R}|$ was lowered by 0.03 or greater, i.e., $\delta|\bar{R}|0.03$ below that of bare metal.

The dielectric response function of the constituents of the lossy layer d is the second major materials property entering into the subject definition of effective optical constants of the absorber medium that are of primary importance in the absorber materials design strategy of the present invention. An effective medium dielectric response is a viable materials design parameter, especially for wave propagation factors within the lossy layer.

A variety of insulating and conductive dielectric particulates have been evaluated for control of the effective medium dielectric response function of the lossy layer. The dielectric response function contributes to heating performance by combining with the magnetic response function to define the absorber reflection coefficient and the wavelength of the microwave energy propagating within the lossy layer. Because the magnetic component exerts the dominant influence on the reflection coefficient at the small lossy layer thicknesses of the present invention, the major use of the dielectric response is to control wave propagation factors, e.g., wavelength compression, within the lossy layer.

Generally, utilization of the largest available value of $K_{er}$ provides maximum wavelength compression within the lossy layer d, as indicated by $\lambda$ in the figure. The wave outside of the lossy layer in the figure is indicated by $\lambda_0$. (Wavelength alteration is an optical phenomenon of a refractive material, and is defined by Maxwell's equations.) Sufficient wavelength compression provides a finite electric field strength within practical lossy layer dimensions and thus contributes to heat generation directly within the lossy layer, and enables implementation of a supplementary artifice like film 3 in the figure, as discussed in detail below. The compression of the incident wavelength $\lambda_0$ to the $\lambda$ in the lossy medium of d is determined by the above complexes of composite magnetic permeability and electric permitivity. The figure shows the relative magnetic permeability, $\overline{K}_m$ (complex number), and relative electric permitivity, $\overline{K}_e$ (complex number), for the lossy layer, d, of the D-layer. The tangential electric field component of the electromagnetic wave of incident power $P_I$ is shown with a maximum at the location of film 3, which elicits the greatest contribution to heat generation in the absorber. As it turns out, it is not feasible to capture three quarters of $\lambda$ in the lossy material when the layer thickness d is a primary consideration. Hence, the practical objective of materials engineering must be to minimize reflected power $P_R$, maximize power absorption $P_A$ and minimize $\lambda$ to achieve a time-temperature response q(t) that satisfies criteria derived from cooking experience.

However, $|\overline{R}|$ will begin to approach 1 as $K_{er}$ becomes very large, say greater than 100, so that the dielectric materials and their concentrations in the lossy layer d must be judiciously chosen to maintain a balance between $\overline{K}_e$ and $\overline{K}_m$ that will preserve useful impedance while maximizing wavelength compression. For existing available magnetic particulates, balance can be achieved using conducting and/or insulating particulates like aluminum flake, carbon black, metal-coated and uncoated dielectric spheres. These have been evaluated for purposes of the present invention and have proven to be effective in manipulating the wave propagation factors to achieve the goals of the present invention. Selected ferroelectric crystals of perovskite structure (e.g., barium titanate) and molecular species having significant permanent electric dipole or chiral structure will also work well. Other types of dielectric materials are feasible for this use including semiconductors, doped mixed metal oxides, etc., but these are generally more cost prohibitive or are less amenable to recycling.

In addition to the optical properties which enable interaction with an incident electromagnetic wave, the thermal transport properties of an active microwave absorber are of critical importance for effective absorber designs. The thermal transport properties of the lossy layer enter into thermal balance between the absorber and load. The desired, final load temperature is specified by the application, e.g., by the particular needs of the food packager. In normal practice, the absorber is driven to satisfy these demands through choice of absorber materials, the thickness of the lossy layer, its distribution over the surface of the metal container, design of container geometry, and, as far as allowed within the packaging application, through manipulation of the thermal and electrical boundary conditions of the absorber. The present invention utilizes absorber materials that optimize the thermal response under boundary conditions suitable for a wide variety of food loads in the case the continuous substrate is a metal foil.

This goal is accomplished by employing high thermal conductance particulate loadings in the lossy d layer at levels lying beyond "percolation threshold", while remaining cognizant of their influence on the net optical properties of the absorber. Percolation threshold refers to the level or amount of particulates in a polymer layer that provides an intraparticle spacing small enough to allow efficient particle-to-particle coupling of thermal phonons and electronic transport throughout the lossy layer.

Aluminum foil is an excellent thermal conductor, as discussed earlier, but an overlying lossy layer may or may not exhibit good thermal transport properties depending upon the relative proportion of high thermal conductance metallic and/or insulating particulates that are employed in a particular design. If loadings are low in comparison to percolation threshold, thermal transport within the lossy layer will be governed by the polymer matrix, and heat transport will thus be inefficient; the lossy layer will therefore tend to reach high internal temperatures under the intrinsic heat generation rates that are needed in the process of directly heating the metal of the container and its contents.

Alternatively, high thermal conductance particulates loaded at or beyond percolation threshold will dominate the thermal transport properties of the composite lossy layer so that transport of the heat generated via TEM/particulate interaction will be efficient, and the lossy layer will run "cool", i.e, the temperature of the layer will remain at or near load (food) temperature for thawing and/or cooking. As noted earlier, semi-transparent films with low bulk loadings of active dielectric material, as typically employed, insures that the poorly conducting polymer matrix will dominate thermal transport properties.

High particulate loadings can be made consistent with superior optical properties, which properties provide maximum power absorption, as limited by the intrinsic magnetic and dielectric properties of commercially available materials. Theory and experiments have shown that metallic, nonmetallic, semi-metals, and inorganic crystalline materials having high thermal conductances can be mixed with primary magnetic particles according to prescriptions of the present invention to enhance thermal performance without adversely affecting the effective optical properties of the absorbing medium.

The optical response of the lossy layer and metal substrate (the D-layer) can be calculated using the following three equations appropriate for a TEM normally incident on a semi-infinite planar surface:

$$\bar{z}/z_0 = [\bar{K}_m/\bar{K}_e]^{\frac{1}{2}} \tanh\bar{\Gamma}d \quad (1)$$

where: the bar denotes a complex quantity;

$\bar{z}=\bar{E}/\bar{H}$ which is the (complex) impedance of the D-layer;

$$z_0 = [\mu_o/\epsilon_o]^{\frac{1}{2}}$$

is the characteristic impedance of free space, where $\lambda_o$ and $\epsilon_o$ are the permeability and permittivity of free space, respectively, and $z_0=377\ \Omega$ in the MKS system of units (an unoccupied oven cavity space is taken as free space ignoring the relatively small corrections to $\lambda_o$ for wave propagation in the cavity);

$$\bar{\Gamma} = i(\omega/c)\,[\bar{K}_m\bar{K}_e]^{\frac{1}{2}} = \alpha + i\beta$$

which defines the wave propagation factors of interest as follows:

$\alpha$=real $\bar{\Gamma}$=absorption coefficient, $cm^{-1}$, in the lossy layer;

$\beta$=imag $\bar{\Gamma}$=phase factor, $cm^{-1}$, in the lossy layer;

$\lambda=2\pi/\beta$=wavelength, cm, within the lossy layer;

$\omega=2\pi\nu$=circular frequency, radian/sec, of the transverse electric wave (TEM);

c=speed of light in vacuum=$3\times10^{10}$ cm/sec;

the electric and magnetic field vectors are, respectively, $\bar{E}=E_0e(-\bar{\Gamma}x-i\omega t)$ and $\bar{H}=\bar{H}_0e(-\bar{\Gamma}x-i\Omega t)$;

in the TEM mode, E and H are normal both to one another and to the direction of wave propagation;

d is the thickness in cm of the composite lossy layer located on metal substrate 2;

$\bar{K}_e=K_{er}+iK_{ei}$ is the effective medium electric permittivity of the particulate/molecular composite lossy layer relative to free space, and is frequency sensitive in the microwave region for the materials of interest; $\bar{K}_e$ is also known as the dielectric response function in accordance with the terminology of linear response theory;

$\bar{K}_m=K_{mr}+iK_{mi}$ is the effective medium magnetic permeability of the particulate composite lossy layer relative to free space, and is frequency sensitive in the microwave region for materials of interest; $\bar{K}_m$ is also known as the magnetic response function in accordance with the terminology of linear response theory; $\bar{K}_e$ and $\bar{K}_m$ together are often referred to as the optical constants of a particulate-filled lossy layer composite.

The amplitude reflection coefficient (complex number) of the D-layer is:

$$\bar{R}=[(\bar{Z}/Z)-1/(\bar{Z}/Z_o)+1] \quad (2)$$

Power absorption in the D-layer is given by:

$$\dot{G}(\text{total})=P_I[1-|\bar{R}|(d,\omega,\bar{K}_m,\bar{K}_e)|^2|] \quad (3)$$

where $P_I$ is the, power density, cal/cm$^2$ sec, incident on the D-layer the impedance of film 3 of FIG. 1 can be accounted for by adding the intrinsic, relative impedance of the thin film in parallel with the relative impedance of the D-layer to give the net relative impedance of the layer composite depicted in FIG. 1. The relative impedance of film 3 includes, of course, electrical resistance in ohms/square.

These equations suggest that all quantities relevant to the evaluation of the performance of the absorber structure in a microwave environment can be evaluated through independent measurement of $\bar{K}_m$ and $\bar{K}_e$ and film 3 resistance at the frequency of interest. Measurement-based functionals supported and extended by theory, giving $\bar{K}_m$, $\bar{K}_e$ in terms of the particulate concentrations, supply the constitutive relationships needed to complete the performance model.

Experiments employing calorimetric heating measurements in consumer microwave ovens, in conjunction with transmission line measurements of $\bar{K}_m$ and $\bar{K}_e$, have verified the efficacy of the equations for predicting the key performance parameter $\dot{g}$ of aluminum foil containers overlayed with an absorbing material constructed according to the prescriptions of the present invention. Moreover, excellent agreement between theory and experiment has been obtained when $\bar{K}_m$ and $\bar{K}_e$ are interpreted in terms of effective medium theory even though the consumer oven departs substantially from the simplifying assumption of a TEM wave normally incident on a semi-infinite planar surface. Departures from the predictions of the influence of $\bar{K}_m$, $\bar{K}_e$ and d (lossy layer thickness) embodied in these equations have been found to produce second order contributions to heat generation, as previously discussed.

The figure of the drawing shows a thin electrically resistive film e that can be placed on the D-layer by any of several possible means. The film has a specific intrinsic impedance that aids the match of the impedance of the D-layer to the free space lying adjacent to ,the lossy layer on the metal substrate 2 as described above. Such impedance matching improves power absorption in the net absorber structure, and mechanistically contributes to the net heat generation rate via $I^2R$ losses originating within the film. The film impedance is adequately characterized for present purposes by relative film resistance in $\Omega$/sq. measured at zero frequency. The efficacy of the film has been experimentally demonstrated. Current experience indicates that such films begin to noticeably contribute to the impedance match at lossy layer thicknesses beyond 4 mils for a well designed D-layer. Typical intrinsic impedance values for such films computed to be optimum range from about $5\Omega$/sq for a 5 mil lossy layer comprised of 1:1 (wt/wt iron/polymer), an inadequate absorber composition which film 3 can improve upon but little, to $55\Omega$/sq for a 15 mil, 5:1 iron/polymer D-layer having $\delta|\bar{R}|=0.06$ (which is equivalent to a 12% increase in power absorption relative to bare metal without the film). Vapor deposited films for this purpose typically range between 100 and 200 nanometers in thickness, depending upon the chemical structure of the metal compound employed in the film and the desired intrinsic impedance. A reference showing appropriate thin film parameters and materials U.S. Pat. No. 4,866,235 to Griffin et al.

As an example of a reduction to practice, the use of an impedance matching thin film 3 of the invention on a 21 mil thick D-layer containing aluminum flake and having a final composition 5:1:1 (wt/wt/wt, iron/aluminum flake/polymer), with the thin film having an electrical resistance of $51\Omega$/sq, produced an observed 20% greater heat generation rate than the same D-layer without the film. The theoretical enhancement calculated from the decrease in reflection coefficient commensurate with the improved impedance match with free space effected by the film was 7%. Similarly, a 2:1 iron/polymer 21 mil thick sample increased in heat generation rate by 5% with the addition of an 85Ω/sq thin film, while theory estimated a 3% increase.

Note that a main difference between the two D-layers cited is the presence of aluminum in the first. The aluminum strongly influences the wave propagation factors. The ratio of the wavelengths in the 5:1:1 and the 2:1 formulation is 0.818 cm/3.09 cm, which is equal to 0.265, so that the addition of aluminum flake reduced the wavelength within lossy layer d by nearly ⅓. This magnitude of wavelength compression may be sufficient to enable some electric field induced heating in film 3 and lossy layer d of 5:1:1 that is absent in the 2:1 iron/polymer D-layer, which may account for the disproportionate enhancement in performance in 5:1:1 over 2:1.

Other materials in the lossy layer composition and other dimensions of d are possible so that any thin film 3 that is used to provide impedance matching will need to be optimized in terms of the materials and dimensions of the lossy layer. Such scaling is based upon independently measurable effective medium electric permittivities and magnetic permeabilities, and the relative electrical resistance of the thin film.

The above example shows that the gain in heat generation rate through the use of a thin lossy film can be of a significant magnitude.

As described above the present invention provides a substantially complete specification for absorber performance with respect to the heating rate of loads (foods) contained in a metal foil or container, which includes consideration of loading effects on optical parameters including wave propagation factors, on thermal transport efficiency, on temperature control, and recognition of the fact that there is a great variety of consumer ovens and consumer procedures existent in the marketplace. Loading of particulates at and beyond percolation threshold addresses all of these considerations. The invention thus is able to implement primary considerations in practical metal container designs, using known particulates and molecular species in continuous films that are compatible with existing, economical processing and production techniques and established recycling procedures wherein a metal substrate is the central feature of a food package.

A general principle lying behind the uniqueness of the microwaveable foil concept of the invention is the well-known sensitivity of food preparation rates, consistency, taste, odor, color and texture to the wavelength of the electromagnetic energy (2.45 GHz) generally employed in food preparation. As a specific example, it is known that frozen foods react more rapidly to the thermal energies presented to them by the foil-based absorber of the invention than to microwave radiation directly absorbed by frozen foods. In the most extreme case, ice contained in a microwave-transparent container is known to heat more slowly than liquid water in the same container. This order of heating efficiency is reversed when using the coated foil of the invention. Reversal occurs because the thermal transport in ice is more efficient than the thermal transport in liquid water, while direct interaction and thermalization of microwave energy is more efficient in liquid water than in ice crystals.

These sorts of observations, when interpreted within the sound framework of modern physics, help to differentiate a metal foil based absorber concept from other absorber strategies, such as those based upon the partial transmission of microwave energy that allows utilization of the electric field component of the transverse electromagnetic (TEM) wave to generate heat within a surface or bulk modified polymer film. As previously noted, semi-transparent films can heat efficiently, but do so at the expense of severe limitations to the electrical and thermal boundary conditions that can be tolerated in their use. Indeed, semi-transparent films and microwave foil strategies are best viewed as supplementary rather than complementary in food preparation applications. The differing and distinct limitations on the thermal boundary conditions tolerable within the two strategies also translates into the ability to control and limit the maximum levels in temperature to which the absorber and metal will be heated.

While the invention has been described in terms of preferred embodiments, the claims appended hereto are intended to encompass all embodiments which fall within the spirit of the invention.

What is claimed is:

1. A device for heating food loads comprising:

a continuous, microwave opaque metal substrate;

a layer of organic material containing microwave absorbing dielectric and magnetic particles located on a least a portion of said continuous microwave opaque metal substrate, and having a predetermined thickness to provide an effective interaction with incident microwave radiation wherein mostly magnetic losses occur within the organic layer when microwave energy having a predetermined wavelength enters said organic layer, thereby producing heat generation within the organic layer, the dielectric particles within said organic layer being effective to compress the wavelength of the microwave energy while simultaneously preserving an appropriate impedance of said organic layer to free space for effecting said magnetic losses and heat generation, said dielectric and magnetic particles, in addition, being effective to transport heat produced within said organic layer through said continuous microwave opaque metal substrate at rates sufficient to maintain the temperature of said device at substantially near said food loads.

2. The device of claim 1 in which the metal substrate is aluminum foil or sheet.

3. The device of claim 1 in which the magnetic particles is a ferrite.

4. The device of claim 1 in which the magnetic particles is particulate iron.

5. The device of claim 1 in which the predetermined thickness of the organic layer is in a range of five to fifteen mils.

6. The device of claim 5 in which the particulate iron is 75 to 85 percent by weight of the organic layer.

7. The device of claim 1 in which the dielectric particles are electrically conductive particulates.

8. The device of claim 1 in which the dielectric particles are metal flakes.

9. The device of claim 1 in which the dielectric component particles are is selected from the group consisting of uncoated dielectric micro size spheres, metal coated dielectric micro size spheres, aluminum flakes carbon black, ferroelectric crystals of perovskite structure.

10. The device of claim 1 in which a concentration of dielectric and magnetic particles in the organic layer provide thermal transport properties in said layer sufficient to insure that an operating temperature of an said device is maintained substantially at the temperature of the food loads.

11. The device of claim 1 in which the dielectric particles of said organic layer are electrically insulative particles.

12. A method of making a device having a lossy layer of a predetermined thickness and composition disposed on a continuous metal microwave opaque substrate to have a predicted ability to interact with incident microwave energy for heating purposes, the method comprising:

selecting a minimum thickness of the lossy layer consistent with the complex optical constants of dielectric and magnetic particles in the layer in enhance absorption of incident microwave energy, manipulating said absorption based upon said minimums thickness by controlling the composition of said lossy layer in terms of said ability to interact with incident microwave energy, wherein said composition includes dielectric and magnetic particles, said dielectric particles being effective to compress the wavelength of the microwave energy while simultaneously preserving an appropriate magnetic impedance to the magnetic particles for effecting magnetic losses, and applying an impedance matching film on a surface of said lossy layer at a location opposite to that of the metal substrate, said film being effective to reduce reflection of the incident microwave energy from the lossy layer and enhance said absorption and heating performance in said device.

13. The method of claim 12 in which said thickness of is less than one half millimeter.

* * * * *